US008967245B2

(12) United States Patent
Farrar et al.

(10) Patent No.: US 8,967,245 B2
(45) Date of Patent: Mar. 3, 2015

(54) BOREHOLE SEAL, BACKUP AND METHOD

(75) Inventors: Amy L. Farrar, Houston, TX (US); Edward T. Wood, Kingwood, TX (US); Gregory C. Badke, Houston, TX (US); Robert O. Castillo, Stafford, TX (US); Anthony P. Foster, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 197 days.

(21) Appl. No.: 13/114,519

(22) Filed: May 24, 2011

(65) Prior Publication Data

US 2012/0299246 A1 Nov. 29, 2012

(51) Int. Cl.

| | |
|---|---|
| ***E21B 23/00*** | (2006.01) |
| ***E21B 33/12*** | (2006.01) |
| ***E21B 33/128*** | (2006.01) |

(52) U.S. Cl.

CPC ..... *E21B 33/1208* (2013.01); *E21B 33/1212* (2013.01); *E21B 33/1216* (2013.01); *E21B 33/128* (2013.01)

USPC ..... 166/217; 166/387; 277/314; 277/316; 277/338; 277/604; 277/602; 285/345; 285/346

(58) Field of Classification Search

USPC ..... 277/314, 316, 603, 604, 616, 625, 338, 277/342; 166/387, 217; 285/345, 346

See application file for complete search history.

(56) References Cited

U.S. PATENT DOCUMENTS

| | | | | |
|---|---|---|---|---|
| 2,376,995 | A * | 5/1945 | Fisher | 277/616 |
| 2,775,304 | A * | 12/1956 | Zandmer | 166/100 |
| 3,510,139 | A * | 5/1970 | Potter | 277/603 |
| 3,591,191 | A * | 7/1971 | Coderre et al. | 277/627 |
| 3,606,348 | A * | 9/1971 | Taylor | 277/328 |
| 4,186,931 | A * | 2/1980 | Anderson | 277/603 |
| 4,394,025 | A * | 7/1983 | Anderson | 277/617 |
| 4,410,185 | A * | 10/1983 | Sporre | 277/314 |
| 4,844,165 | A | 7/1989 | Van Der Steeg | |
| 5,249,811 | A * | 10/1993 | Bruckner et al. | 277/314 |
| 5,330,002 | A * | 7/1994 | Saunders | 166/208 |
| 5,839,765 | A * | 11/1998 | Carter et al. | 285/334.2 |
| 5,931,476 | A * | 8/1999 | Ungchusri et al. | 277/603 |
| 6,003,873 | A * | 12/1999 | Solberg | 277/323 |
| 6,260,851 | B1 * | 7/2001 | Baron | 277/603 |
| 6,325,389 | B1 * | 12/2001 | Sharify | 277/604 |
| 6,948,715 | B2 | 9/2005 | Taylor et al. | |
| 7,086,479 | B2 * | 8/2006 | Schultz et al. | 166/381 |
| 7,458,392 | B2 * | 12/2008 | Cornwell | 137/529 |

(Continued)

OTHER PUBLICATIONS

International Search Report and Written Opinion; International Application No. PCT/US2012/038625; International Filing Date: May 18, 2012; Date of Mailing Nov. 5, 2012; 10 pages.

*Primary Examiner* — Kristina Fulton
*Assistant Examiner* — Eugene G Byrd
(74) *Attorney, Agent, or Firm* — Cantor Colburn LLP

(57) ABSTRACT

A method and assembly for reducing a radial gap between radially proximate components including a setting member having a first dimension that partially defines the radial gap, the setting member including a circumferential groove extending radially from the first dimension, and a first toroid having a second dimension, the setting member operatively arranged to engage with the first toroid, wherein increasingly engaging the setting member with the first toroid enables a boundary dimension of the assembly to be extended toward the radial gap for reducing the radial gap, the circumferential groove operatively arranged to catch the first toroid when the setting member is fully engaged with the first toroid.

7 Claims, 9 Drawing Sheets

(56) References Cited

U.S. PATENT DOCUMENTS

| | | | | |
|---|---|---|---|---|
| 7,469,750 | B2 | 12/2008 | Carr | |
| 7,735,877 | B2 * | 6/2010 | Ito et al. | 285/239 |
| 8,051,913 | B2 * | 11/2011 | Huang et al. | 166/387 |
| 2003/0042028 | A1 * | 3/2003 | Lauritzen et al. | 166/384 |
| 2004/0256808 | A1 * | 12/2004 | Tsuboi et al. | 277/377 |
| 2005/0028990 | A1 | 2/2005 | Atkins et al. | |
| 2006/0014269 | A1 * | 1/2006 | Streit et al. | 435/287.1 |
| 2010/0140876 | A1 * | 6/2010 | Richards | 277/314 |

* cited by examiner

BOREHOLE SEAL, BACKUP AND METHOD

BACKGROUND

In the downhole drilling and completions industry packers or seal elements are ubiquitously used for a myriad of sealing and inhibition applications. There are many kinds of sealing elements available in the industry but since conditions encountered are ever changing, the industry is always receptive to new configurations providing sealing capability.

BRIEF DESCRIPTION

An assembly for reducing a radial gap between radially proximate components including a setting member having a first dimension that partially defines the radial gap, the setting member including a circumferential groove extending radially from the first dimension, and a first toroid having a second dimension, the setting member operatively arranged to engage with the first toroid, wherein increasingly engaging the setting member with the first toroid enables a boundary dimension of the assembly to be extended toward the radial gap for reducing the radial gap, the circumferential groove operatively arranged to catch the first toroid when the setting member is fully engaged with the first toroid.

A system including a pair of assemblies, each assembly including a setting member having a first dimension that partially defines the radial gap, the setting member including a circumferential groove extending radially from the first dimension, and a first toroid having a second dimension, the setting member operatively arranged to engage with the first toroid, wherein increasingly engaging the setting member with the first toroid enables a boundary dimension of the assembly to be extended toward the radial gap for reducing the radial gap, the circumferential groove operatively arranged to catch the first toroid when the setting member is fully engaged with the first toroid, and a plurality of subsequent toroids arranged in a sealing area between the first and second end assemblies.

A method of reducing a radial gap between radially proximate components including engaging a first toroid with a setting member, the setting member at least partially defining the radial gap and having a radially extending circumferential groove, increasingly engaging the setting member with the first toroid, wherein increasingly engaging the first toroid enables a boundary dimension of the assembly to be extended toward the radial gap for reducing the radial gap, and locating the first toroid in the circumferential groove when the setting member becomes fully engaged with the first toroid.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
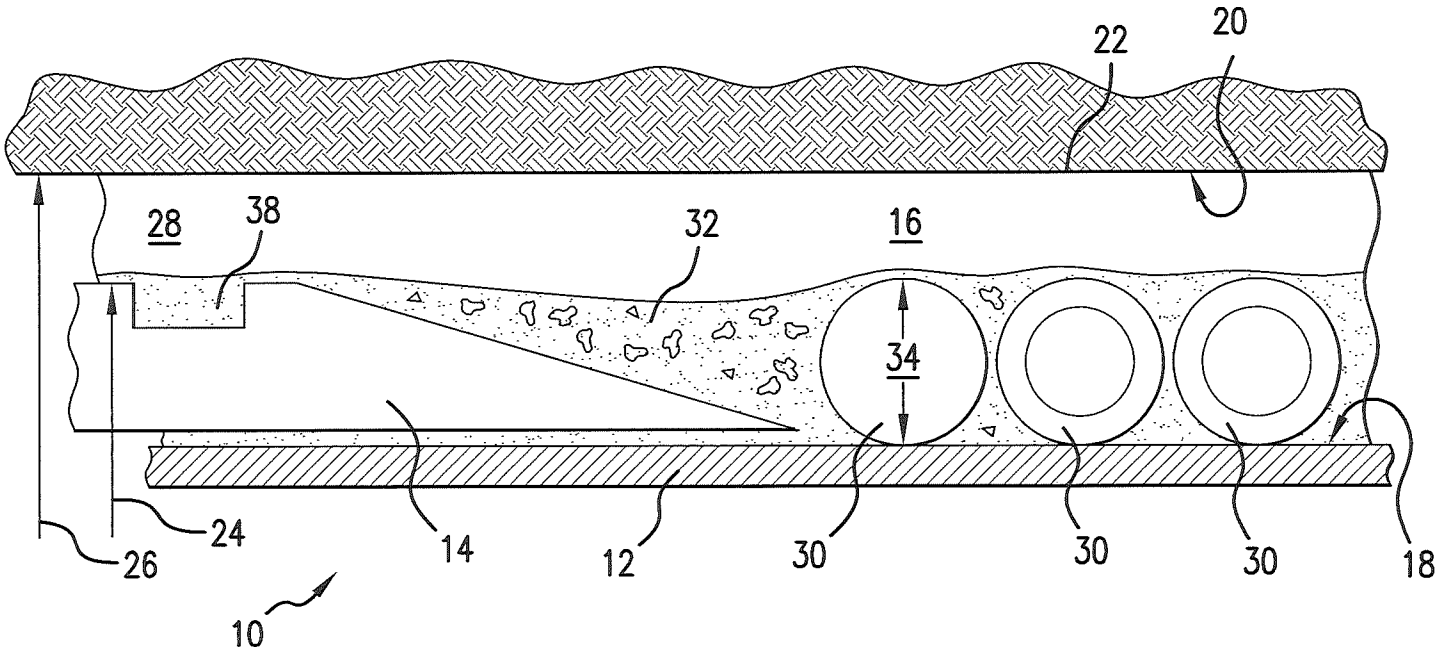
FIG. 1 is a quarter-sectional schematic view of an assembly for reducing an extrusion gap or the like, as described herein in a pre-deployment position.
Figure 2:
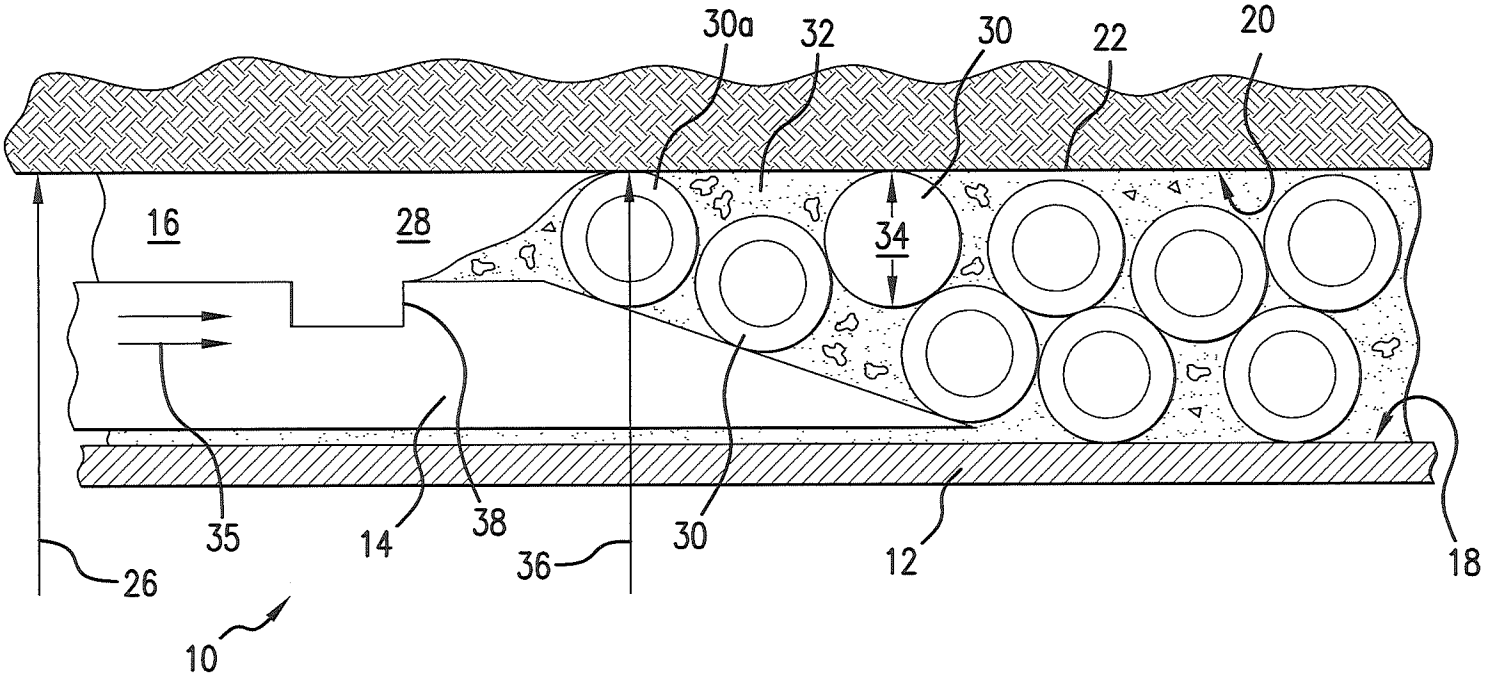
FIG. 2 is a quarter-sectional schematic view of the assembly of FIG. 1 in a deployed position.

A detailed description of one or more embodiments of the disclosed apparatus and method are presented herein by way of exemplification and not limitation with reference to the Figures. Referring now to the drawings, FIGS. 1 and 2 show a quarter-section of an assembly 10. The assembly 10 includes a mandrel 12 having a setting member or wedge 14. The assembly 10 is located in an annulus 16, which is formed between an outer circumferential surface 18 of the mandrel 12 and a bore wall 20 of a borehole 22. However, it is to be appreciated that the assembly 10 could be installed in an annulus formed between any set of tubulars and/or boreholes. As used herein the term "tubular" may generally include any tube-like structure, whether cylindrical or not, such as a tube, pipe, collar, casing, tubing, liner, etc.

Wedge 14 has an outer dimension 24 and borehole 22 has a dimension 26, with a gap 28 formed between the outer dimension 24 of the wedge 14 and wall 20 of the borehole 22. For example, the dimensions 24 and 26, or any other dimension referred to herein, could be radii, major radii, minor radii, diameters, distances from a reference point, etc. As described in more detail below, a toroid 30 (or a plurality of toroids 30) is included to seal, block, obstruct, close, or otherwise alleviate or prevent extrusion of a sealing element through the gap 28. It is to be appreciated that with reference to the embodiments described herein, the term "toroid" as used herein relates generally to any annular, ring, or donut shaped body, regardless of cross-sectional geometry, and that the body may be solid, hollow, or otherwise hollow, but packed or filled with another material. The toroids described herein are generally stretchable, compressible, durable, resilient, and/or otherwise able to change in shape, size, thickness, etc. When applicable, the term "toroid" is to be interpreted broader than "torus" or "ring", which both imply circumferential continuity. For example, as used herein, the term "toroid" encompasses bodies that are not only circumferentially continuous, but also bodies which contain a split, break, or open end, for example resembling a 'c' shape, such as is common with piston rings or the like. Thus, a toroid may be formed by rotating a cross-sectional shape at least partially about a line, where the line is in the same plane as the shape and does not intersect the shape. For example, the cross-sectional shape of each of the toroids 30 in FIG. 1 is a circle having a diameter 34, with the diameter 34 defining the thickness of each of the toroids 30, with toroid arranged coaxially with the borehole, mandrel, tubulars, etc. It is also to be understood however that toroids with varying cross-sectional shapes and varying dimensions may be used together in embodiments contemplated herein. That is, any assembly described herein could utilize consistently shaped and sized toroids, or have toroids of various shapes and sizes. For example, although each toroid shown herein has a generally circular cross-sectional shape, other shapes, such as ellipses, rings, etc. could be used. Furthermore, "toroid" could also refer to a body that is wound or coiled or woven, such as a coil spring or garter spring. For example, each toroid 30 could be a coil of a coil spring.

The term "wedge" is used herein to refer to the setting member and components or portions of the setting member, because the setting member is illustrated throughout the drawings as having a conical or frustoconical wedge shape. However, it is to be appreciated that the setting member could take various other shapes and arrangements. For example, in lieu of a tapered wedge, the setting member could include: discrete tiers or steps; a rounded bump or bulge; a lever; an inflatable portion, etc., for engaging under, in, or with the toroids in order to pry, stretch, expand, compress, or otherwise alter the shape, size, and/or position of the toroids (i.e., to set the toroids). Furthermore, it is to be appreciated that the setting member does not need to be circumferentially continuous, for example, the setting member could include a plurality of discrete portions (e.g., each having a wedge-shaped cross-section) spaced about a circumference of a mandrel.

The toroids 30 could act alone as a seal in order to isolate between zones of a borehole, or the toroids 30 could act as a backup for preventing a separate sealing element from extruding through the gap 28. In the embodiment of FIGS. 1 and 2, a material 32 is associated with the toroids 30, e.g., the material 32 could be packed inside the toroids, surrounding the toroids, etc. The material 32 could be, for example, a filler material, an elastomer, a stainless steel mesh containing the toroids 30, etc.

In order to obstruct the gap 28 for inhibiting or preventing extrusion, the wedge 14 is moved axially in the direction indicated by arrows 35. This axial movement results in the toroids 30 engaging with the wedge and expanding as the wedge is inserted further into the toroids 30. Effectively, this interplay between the wedge 14 and the toroids 30 enables a maximum outer dimension 36 of the assembly 10 to increase in order to block or obstruct the gap 28. In FIG. 2, the maximum outer dimension equals dimension 26 of the borehole 22. The maximum outer dimension 36 is defined by the radially outermost point of the assembly 10, which in FIG. 2 is the outer portion of a lead toroid 30*a*, and in FIG. 1 is the outer dimension 24 of the wedge 14. That is, the lead toroid 30*a* is expanded as the wedge 14 is inserted until the lead toroid 30*a* becomes lodged between the wedge 14 and the wall 20 of the borehole 22. It is to be appreciated that the lead toroid 30*a* is marked with an identifier 'a' for sake of discussion only, and otherwise any description of toroids 30 applies generally to lead toroid 30*a*. Expansion of the lead toroid 30*a* creates a blockage in gap 28 for, as noted above, isolating zones of the borehole 22 on opposite sides of the gap 28 or providing a backup function for a separate sealing element that seals and isolates the zones of the borehole 22. In one embodiment, the sealing element takes the form of a plurality of toroids 30 behind the lead toroid 30*a*, with the other toroids 30 lodging together behind the lead toroid 30*a*. In addition to the toroids 30, the material 32 may also assist to obstruct or seal the gap 28 and/or annulus 16 by further impeding passage of sediment, hydrocarbons, debris, or any other substance or particles present in the borehole 22.

Wedge 14 also includes a circumferential groove 38 extending radially inwardly from the outer dimension 24 of the wedge 14. In the event that one of the toroids 30 traverses the entirety of the tapered portion of the wedge, and expands over the outer dimension 24 of the wedge, the groove 38 is included to catch that toroid. This locks the toroid to the wedge so that the toroid essentially becomes a part of the wedge, and further toroids that traverse the entirety of the wedge 14 may engage with, and expand around, the locked toroid. This is described in more detail below with respect to FIG. 5.

Figure 3:
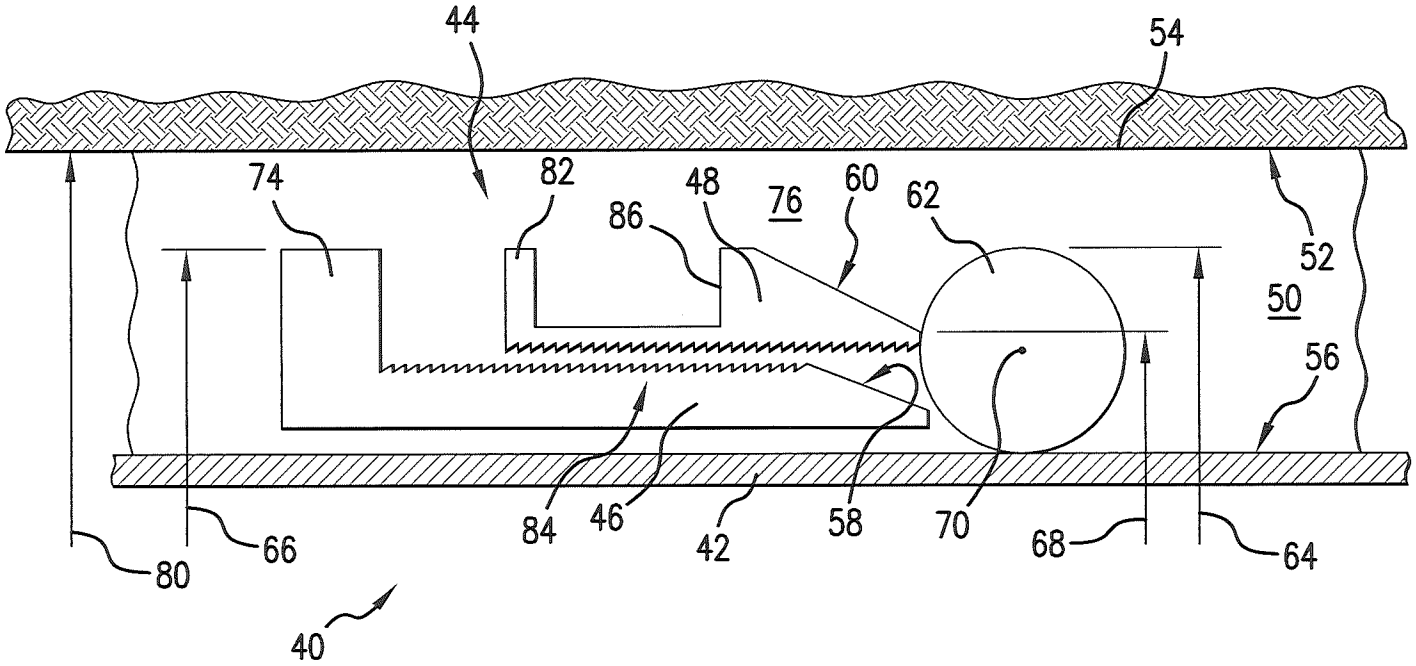
FIG. 3 is a quarter-sectional schematic view of another embodiment of a gap reducing assembly as described herein in a pre-deployment position.
Figure 4:
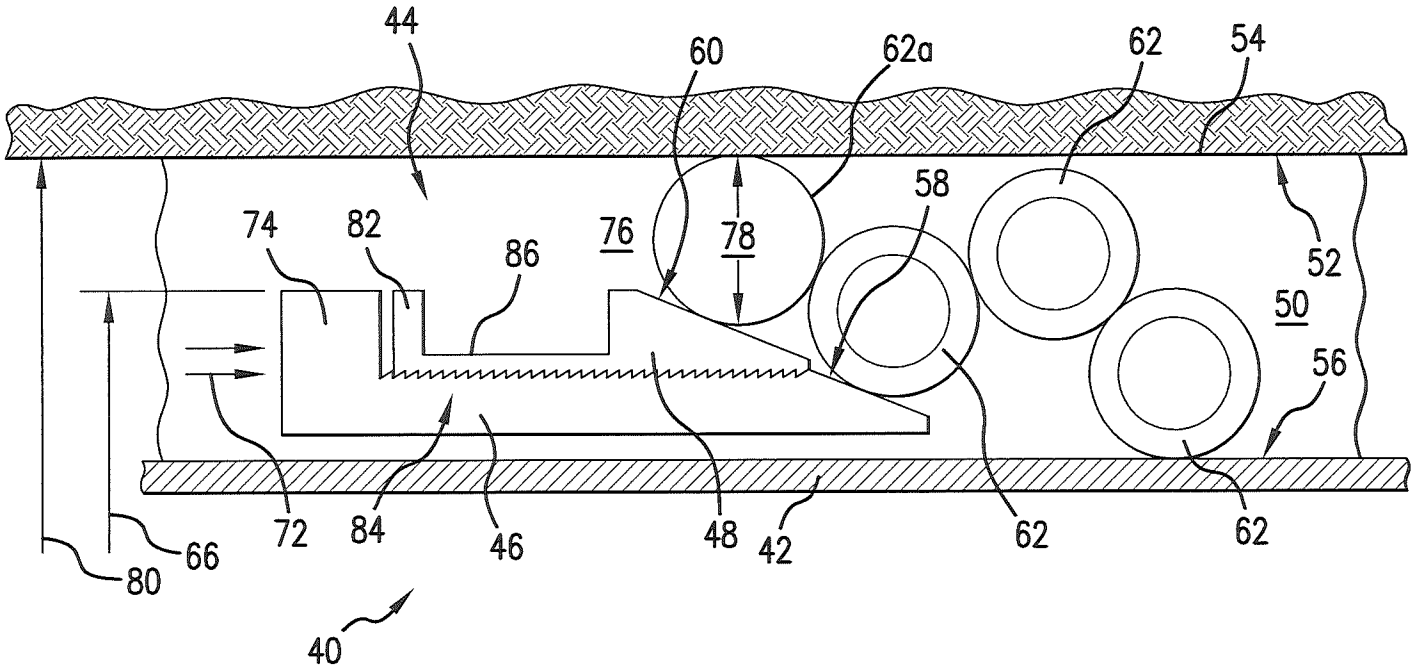
FIG. 4 is a quarter-sectional schematic view of the assembly of FIG. 3 in a deployed position.
Figure 5:
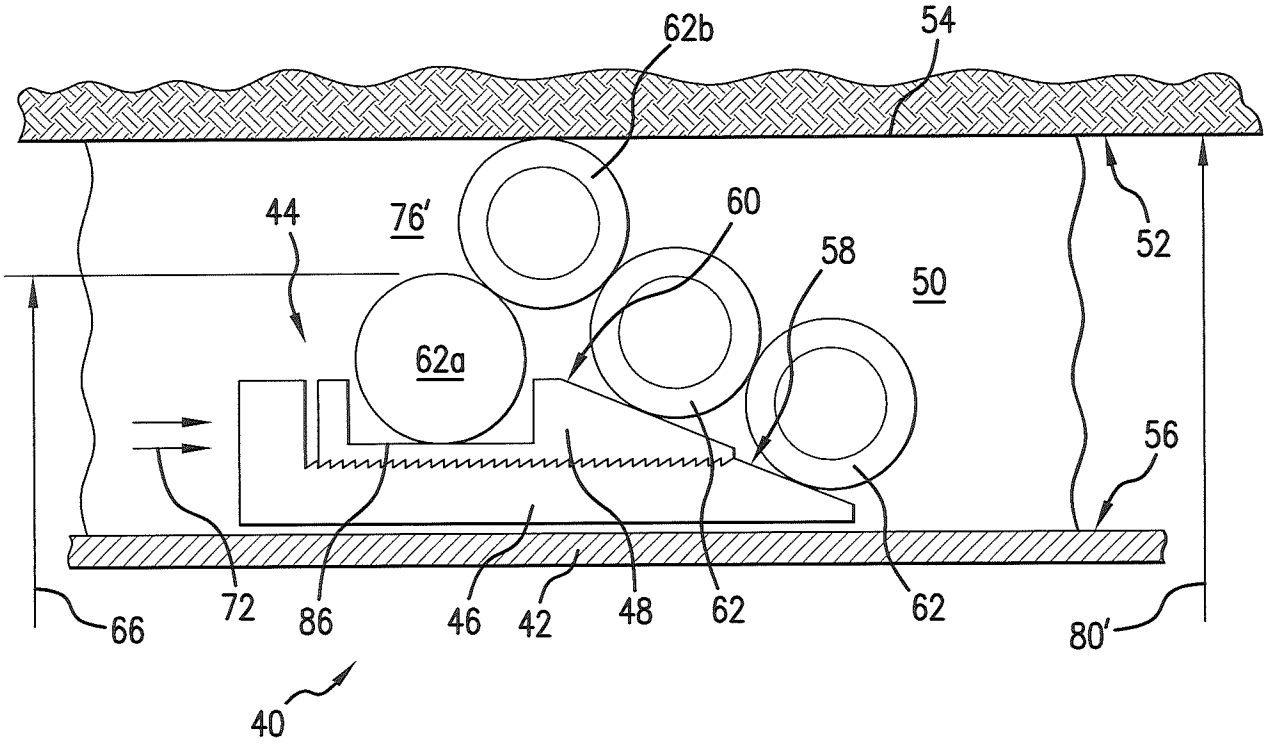
FIG. 5 is a quarter-sectional schematic view of the assembly of FIG. 3 in an alternate deployed position.

Referring to FIGS. 3-5, a second embodiment is shown, designated generally as an assembly 40. The assembly 40 resembles the assembly 10 in several respects, and unless otherwise noted, any description of elements of assembly 10 applies generally to corresponding elements of the assembly 40. The assembly 40 includes a mandrel 42 having a wedge device 44 made up of an inner wedge 46 and an outer wedge 48. That is, the inner wedge 46 is generally positioned radially inwardly from the outer wedge 48. In the embodiment of FIG. 3, the assembly 40 is located in an annulus 50 between a wall 52 of a borehole 54 and an outer surface 56 of the mandrel 42. The inner wedge 46 and the outer wedge 48 are substantially conical or frustoconical in shape, and include tapered shoulders 58 and 60, respectively. In the currently described embodiment, a toroid 62 is located axially in front of the wedge device 44 and has an outer dimension 64, which is approximately equal to an outer dimension 66 of the wedge device 44.

Initially, as shown in FIG. 3, the inner wedge 46 and the outer wedge 48 are arranged such that the inner wedge 46 is located radially inwardly of the outer wedge 48. This initial arrangement deters the toroid 62 from engaging with the shoulder 58 of the inner wedge 46 until the wedge device 44 is set. The toroid 62 is also deterred from engaging with the shoulder 60 of the outer wedge 48 because a minimum outer dimension 68 of the shoulder 60 of the outer wedge 48 of the wedge device 44 is located radially outwardly from a center 70 of the cross-sectional shape that forms the toroid 62 (e.g., in FIG. 3 a circle is the cross-sectional shape that forms the toroid).

By moving the inner wedge 46 axially toward the toroid 62 in the direction indicated by arrows 72 in FIG. 4, the inner wedge 46 of the wedge device 44 is inserted radially inwardly of the toroid 62, and the toroid 62 engages with the shoulder 58 of the inner wedge 46. The inner wedge 46 could be moved, for example, via an electrical, hydraulic, and/or mechanical actuating configuration that in one embodiment applies a load on a radially extending projection or flange 74 of the inner wedge 46. As the inner wedge 46 is loaded further, the toroid 62 expands radially outwardly around the wedge device 44, effectively enabling an increase in the maximum outer dimension of the assembly 40 in order to close or block a gap 76 formed between the wedge device 44 and the wall 52 of the borehole 54. A lead toroid 62*a* is shown in FIG. 4 engaged with, and expanded by, the shoulder 60 of the outer wedge 48 to the extent that the lead toroid 62*a* has also engaged the wall 52 of the borehole 54. In other words, since the gap 76 is smaller than a dimension 78 of the cross-section of the toroid 62*a*, the wedge device 44 has lodged the lead toroid 62*a* in the gap 76 between the outer wedge 48 and the wall 52 of the borehole 54. Similarly to the lead toroid 30*a*, the identifier 'a' is used with lead toroid 62*a* for the sake of discussion only, and any description generally to toroids 62 is applicable to lead toroid 62*a*. Thus, as can be seen by comparing FIGS. 3 and 4, the maximum outer dimension of the assembly 40 has shifted from the outer dimension 66 of the wedge device 44 to the outer dimension of the lead toroid 62*a*, which equals a dimension 80 of the borehole 54 because the lead toroid 62*a* has contacted the wall 52 of the borehole 54.

Relative movement between the inner wedge 46 and the outer wedge 48 is possible, for example, by the lead toroid 62*a* blocking forward movement of the outer wedge 48. The radially extending flange 74 of the inner wedge 46 acts as a stop for limiting the amount of relative movement between the inner wedge 46 and the outer wedge 48 by receiving a radially extending flange 82 of the outer wedge 48. Relative movement is also prevented in the opposite direction because the inner wedge 46 and the outer wedge 48 include complementary ratcheting teeth 84. The complementarily arranged ratchet teeth 84 restrict the axial movement of the inner wedge 46 relative to the outer wedge 48 to only the direction indicated by the arrows 72. Thus, once the flange 82 of the outer wedge 48 has contacted the flange 74 of the inner wedge 46, the two wedge portions are essentially locked together such that the shoulders 58 and 60 form a single ramp for expanding the toroids 62 (as shown in FIGS. 4 and 5).

In FIG. 5, the borehole 54 is illustrated having a dimension 80' greater than the dimension 80 as shown in FIGS. 3 and 4. For example, this could occur if the borehole 54 later became washed out. As a result, a gap 76' in FIG. 5 is larger than the gap 76 in FIGS. 3 and 4, and also larger than the dimension 78 of the cross-sectional shape of the toroids 62. As a result, the lead toroid 62*a* is able to completely traverse the shoulder 60 of the outer wedge 48. Similar to groove 38, a circumferential groove 86 is included in the outer wedge 48. Also similar to the groove 38, if one of the toroids 62, such as lead toroid 62*a*, traverses the entirety of the shoulder 60 of the outer wedge 48, that toroid will become locked in the groove 86. For example, lead toroid 62*a* is shown locked in groove 86 in FIG. 5.

Once one of the toroids 62 becomes locked in the groove 86, that toroid effectively becomes part of the wedge device 44. That is, the lead toroid 62*a* that becomes locked may act like a ramp to essentially increase the size of the wedge device 44, for subsequent toroids, such as a secondary toroid 62*b*, to engage with and expand around. Similar to the identifiers 'a' discussed above, it is to be appreciated that the identifier 'b' is used for the sake of discussion only, and any description of toroids 62 generally applies to secondary toroid 62*b*. Thus, in the embodiment depicted in FIG. 5, it is the secondary toroid 62*b*, not the lead toroid 62*a*, that obstructs the gap 76' by engaging with the wall 52 of the borehole 54. It is to be appreciated that up to three toroids can stack themselves in a stable arch in order to bridge a gap, such as the gap 76 or 76'. Therefore, the gap 76 or 76', measured between the outer dimension 66 of the wedge device 44 (which could be measured as shown in any of FIGS. 3-5), and the wall 52 of the borehole 54, can equal up to three times the dimension 78 of the cross-sectional shape of the toroids 62.

Figure 6:
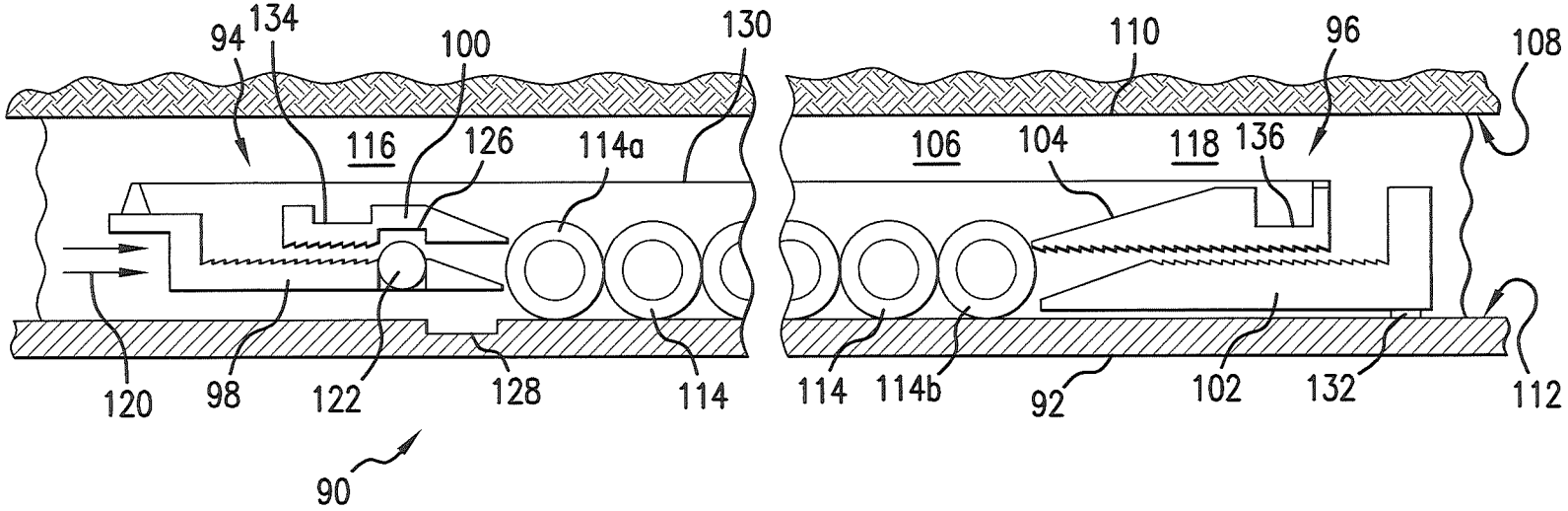
FIG. 6 is a quarter-sectional schematic view of an embodiment of a system including two end assemblies, each resembling the assembly of FIGS. 3-5, in a pre-deployment position.
Figure 7:
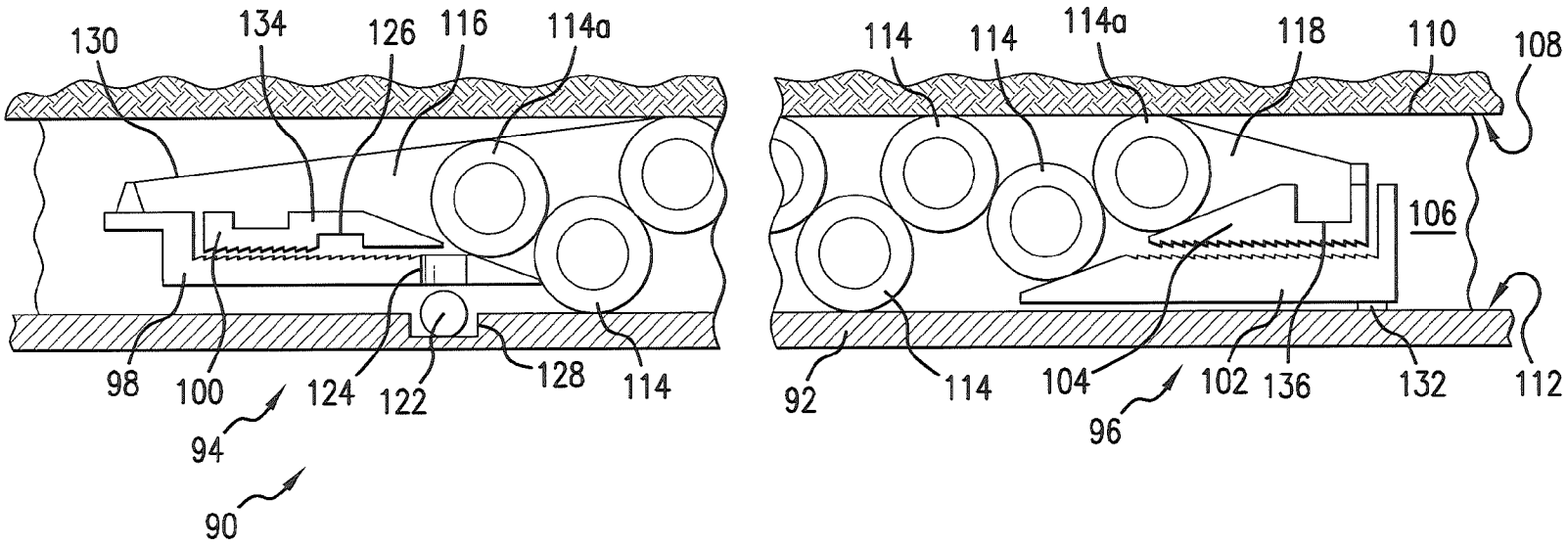
FIG. 7 is a quarter-sectional schematic view of the system of FIG. 6 in a deployed position.

A packer device 90 is shown in FIGS. 6 and 7. The device 90 includes a mandrel 92 having a first end assembly 94 and a second end assembly 96. The end assemblies 94 and 96 both generally resemble the wedge device 44 in that they include two conical or frustoconical wedge portions that can be arranged into single ramp by way of relative movement between the two portions. Specifically, the first end assembly 94 includes an inner wedge 98 and an outer wedge 100, while the second end assembly 96 includes an inner wedge 102 and an outer wedge 104. Similar to the wedge device 44, each of the first and second end assemblies 94 and 96 may include complementarily arranged ratcheting teeth between their corresponding inner and outer wedges, and/or radially extending projections, for limiting the relative movement between their corresponding inner and outer wedges, as described above.

Also similar to the assemblies discussed above, the device 90 is located in an annulus 106 formed between a wall 108 of a borehole 110 and an outer surface 112 of the mandrel 92. Additionally, the device 90 is included to engage with toroids 114 in order to cause the toroids 114 to seal, block, obstruct, or close a set of gaps 116 and 118, located between the wall 108 of the borehole 110 and the first and second end assemblies 94 and 96, respectively. A first lead toroid 114*a* is positioned in front of first end assembly 94 and a second lead toroid 114*b* is positioned in front of second end assembly 96, with a plurality of other toroids 114 located between the lead toroids 114*a* and 114*b*.

The first end assembly 94 operates similarly to the wedge assembly 44. A setting device presses the first end assembly 94 axially in the direction of arrows 120 in order to move the first end assembly 94 along the mandrel 92. Unlike the wedge assembly 44, the first end assembly 94 includes a dog 122 that restricts relative movement between the inner wedge 98 and the outer wedge 100, for example, by being held in an opening 124 of the inner wedge 98 and a notch 126 in the outer wedge 100. Then, when the first end assembly 94 passes over a receiving area 128, the dog 122 can drop out, thereby enabling relative movement between the inner wedge 98 and the outer wedge 100 (at least until the relative movement is restricted again, for example by ratcheting teeth and/or radially extending flanges, as described above with respect to FIGS. 3-5).

The inner wedge 98 of the first end assembly 94 is connected to the outer wedge 104 of the second end assembly 96 via a connecting element 130, which could be, for example, a fixed length of stainless steel mesh. Movement of the inner wedge 98 will exert a force on the lead toroid 114*a*, which will transfer to the outer wedge 104 via the toroids 114 and 114*b*. Since the inner wedge 98 is fixed to the connecting element 130, movement of the inner wedge 98 will result in the connecting element 130 also moving, which will in turn enable the outer wedge 104 to move in the direction of the arrows 120. The movement of the outer wedge 104 exposes the tapered shoulder of the inner wedge 102 so that second lead toroid 114*b* can engage with the shoulder of the inner wedge 102 and expand. The inner wedge 102 does not move because it is fixed to the mandrel 92 at an anchor point 132.

Once the dog 122 is released into the receiving area 128 and relative movement between the inner wedge 98 and outer wedge 100 is possible, the inner wedge 98 will move away from the toroids 114, exposing the tapered shoulder of the inner wedge 98 to the toroids 114, thereby enabling the lead toroids 114*a* to engage with the shoulder of the inner wedge 98 and expand as the inner wedge 98 is inserted therethrough. Inner wedge 98 will be pressed in the direction of the arrows 120 until the gaps 116 and 118 are obstructed by toroids 114*a* and 114*b*, respectively, as shown in FIG. 7. Also, the outer wedges 100 and 104 may include circumferential grooves 134 and 136, respectively, which are included for the same purpose as grooves 38 and 86. Thus, additional toroids 114 may expand over the lead toroids 114*a* or 114*b* if the lead toroids become locked in their respective grooves 134 or 136, with up to three of the toroids 114 able to bridge in a stable arch in order to obstruct the gaps 116 and 118.

Figure 9:
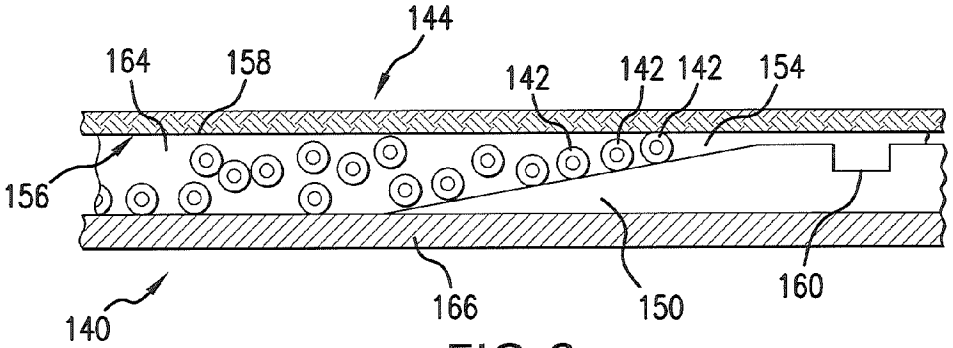
FIG. 9 is a quarter-sectional schematic view of the assembly of FIG. 8 generally taken along line 9-9 in FIG. 8.
Figure 8:
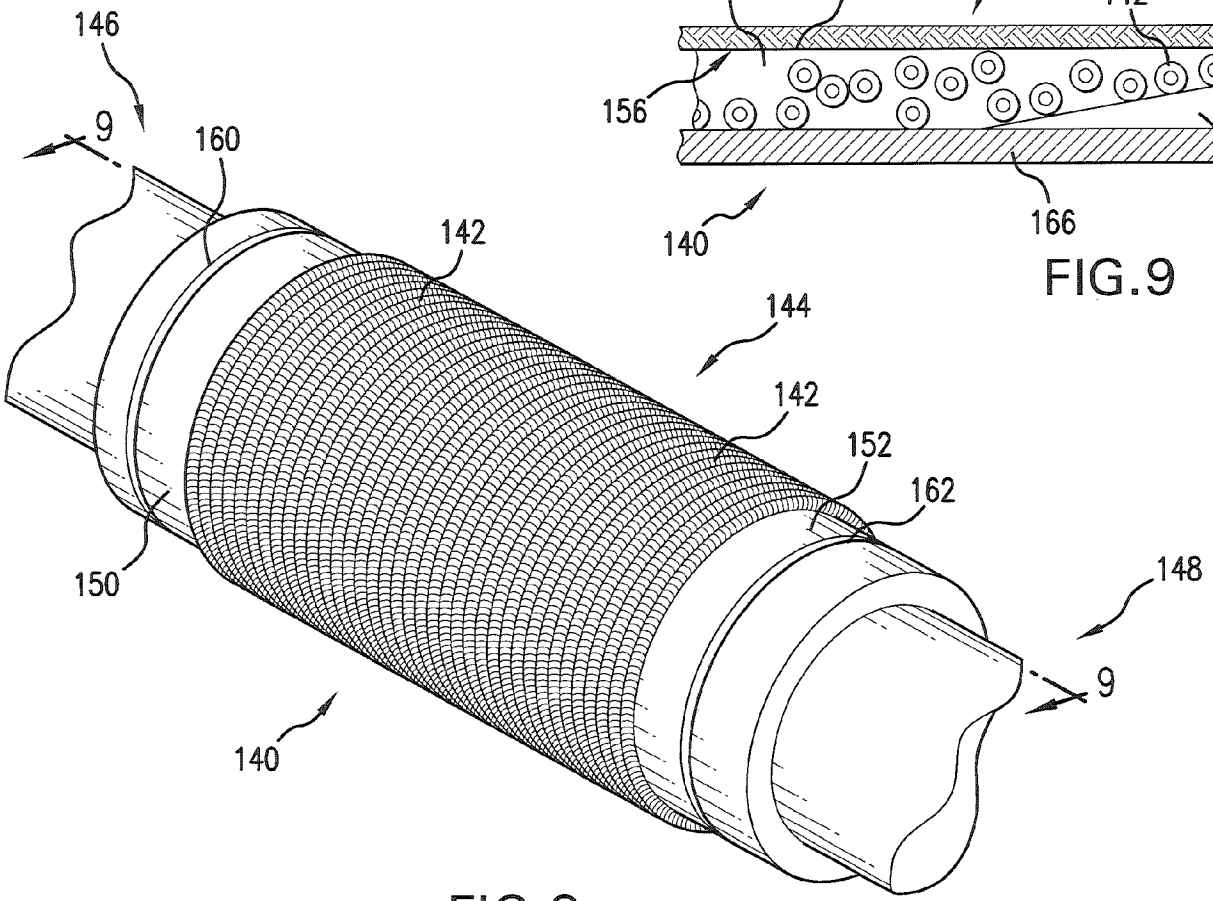
FIG. 8 is perspective schematic view of two zones of a tubular or borehole isolated from each other according to an assembly resembling the assembly of FIGS. 1 and 2.

From FIGS. 8 and 9 it can be better appreciated how a system according to the current invention could be used in order to isolate zones of a borehole, or tubular, from each other. For example, an assembly 140 is shown including a plurality of toroids 142 in a sealing area 144, with the sealing area 144 separating a first zone 146 from a second zone 148 in a sealed manner. In FIGS. 8 and 9, the toroids 142 are shown specifically in the form of garter springs located between a first wedge 150 and a second wedge 152. The toroids 142 are arranged to obstruct extrusion gaps located between the sealing area 144 and the zones 146 and 148. For example, FIG. 9 shows a gap 154, located between the wedge 150 and a wall 156 of a borehole 158, being obstructed by a plurality of the toroids 142. The wedges 150 and 152 may include grooves 160 and 162, respectively. Grooves 160 and 162 resemble grooves 38 and 86, and are included for the same reasons. In view of FIGS. 8 and 9, it is to be appreciated that sealing of an annulus 164, located between a mandrel 166 and the borehole 158, is accomplishable by packing and lodging many of the toroids 142 together.

Figure 10:
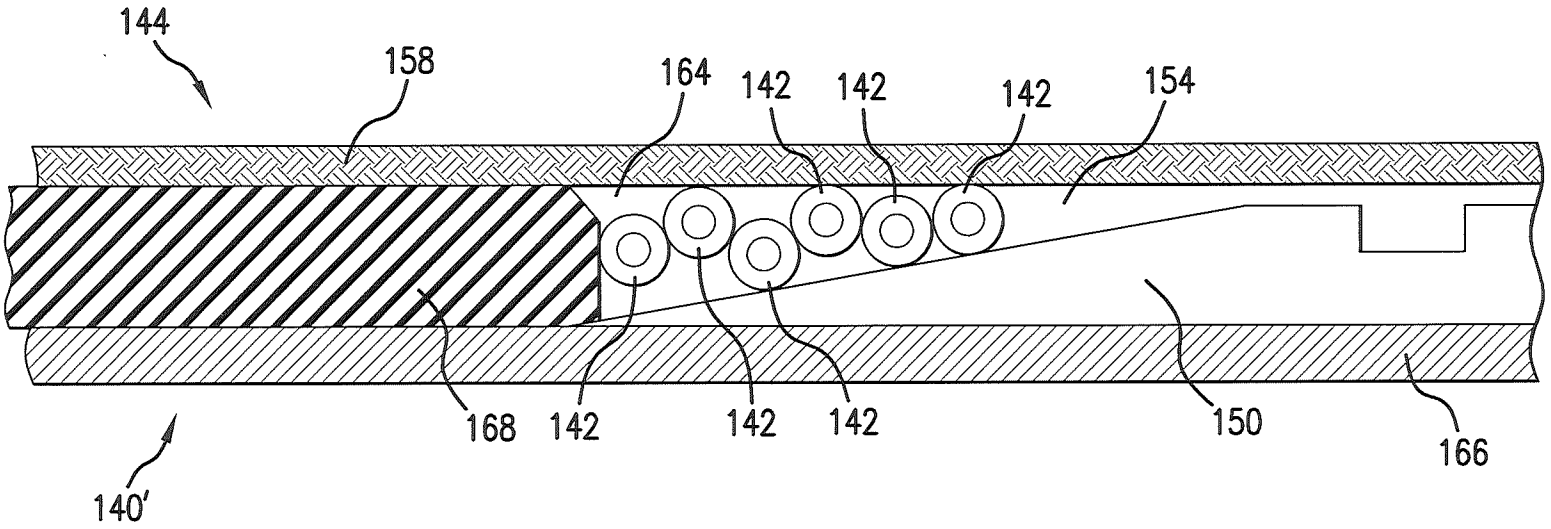
FIG. 10 is a quarter-sectional schematic view of an assembly resembling the assembly of FIG. 9, but including a separate sealing element.

FIG. 10 illustrates an alternate embodiment for the assembly 140, generally designated as an assembly 140'. Specifically with respect to the embodiment of FIGS. 8 and 9, many of the toroids 142 in the sealing area 144 have been replaced with a sealing element 168. The sealing element 168 could be any suitable sealing element used with packer assemblies. As is further appreciable in view of FIG. 10, the toroids 142 are acting as a backup to prevent extrusion of the sealing element 168 through the gap 154, so that the sealing element 168 can seal the annulus 164 between the mandrel 166 and the borehole 158.

It is of course to be appreciated that the components of the various embodiments discussed herein could be interchanged with corresponding or similar components in other discussed variants, or with any other equivalents or substitutes, and that such modifications are within the intended scope of the current disclosure. For example, first and second wedges 150 and 152 could be replaced by any of the other assemblies discussed herein, or the sealing area 144 could be filled with, or surrounded by, stainless steel mesh, steel wool, elastomers, filler material, etc. Furthermore, it is to be appreciated that any of the assemblies described herein could be used as both a backup and a sealing element, or as a backup for a separate sealing element.

It is also to be understood that while the above-described embodiments refer to expanding the toroids to obstruct radially outwardly located gaps, these dimensions could be reversed or inverted. That is, for example, instead of a conical wedge, the setting member could take the form of a funnel arranged radially outwardly from the toroids, for compressing the toroids to obstruct a radially inwardly located gap. For example, the toroids could be made from a partially compressible material, or could take the form of a pre-stretched or plastically deformed garter spring. It is to be noted that illustrations for such inverted embodiments would virtually identically resemble the Figures disclosed herein, as the cross- or quarter-sections would be essentially mirror images of each other. Thus, generally according to the embodiments of the current invention, increasingly engaging a toroid with a suitable setting member (regardless of expansion or compression) results in the setting member altering the toroid (e.g., enlarging or compressing) in order to change a boundary dimension (e.g., a maximum outer dimension, a minimum inner dimension, etc.) of an assembly by extending the boundary dimension of the assembly radially toward the gap to be obstructed.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An assembly for reducing a radial gap between radially proximate components comprising:

a setting member having a first dimension that partially defines the radial gap, the setting member including a circumferential groove extending radially from the first dimension;

and a first toroid having a second dimension, the setting member operatively arranged to engage with the first toroid, wherein increasingly engaging the setting member with the first toroid enables a boundary dimension of the assembly to be extended toward the radial gap for reducing the radial gap, the circumferential groove operatively arranged to catch the first toroid when the setting member is fully engaged with the first toroid, wherein the setting member includes a first portion engaged with a second portion, the first portion arranged radially inwardly from the second portion, the first and second portions at least partially movable relative to each other.

2. The assembly of claim 1, wherein the first and second portions include complementarily arranged ratchet teeth for enabling relative movement between the first and second portions in one direction only.

3. The assembly of claim 1, wherein the first portion includes a first radially extending projection, the second portion includes a second radially extending projection, and relative movement between the first portion and the second portion is limited when the first radially extending projection contacts the second radially extending projection.

4. A system including a pair of assemblies comprising:

a setting member having a first dimension that partially defines the radial gap, the setting member including a circumferential groove extending radially from the first dimension; and a first toroid having a second dimension, the setting member operatively arranged to engage with the first toroid, wherein increasingly engaging the setting member with the first toroid enables a boundary dimension of the assembly to be extended toward the radial gap for reducing the radial gap, the circumferential groove operatively arranged to catch the first toroid when the setting member is fully engaged with the first toroid, wherein a first end assembly of the pair of assemblies is arranged facing a second end assembly of the pair of assemblies, the first toroids and a plurality of subsequent toroids arranged in a sealing area between the first and second end assemblies and wherein the setting member of each of the first and second end assemblies comprises a pair of first and second portions, the first portion of each pair arranged radially inwardly from the second portion of each pair, each pair of first and second portions at least partially movable relative to each other.

5. The system of claim 4, wherein the sealing area isolates a first zone from a second zone of a borehole or a tubular.

6. The system of claim 4, wherein the first end assembly includes a dog for initially preventing relative movement between the first and second portions of the first end assembly, wherein moving the first portion of the first end assembly enables the dog to enter a receiving area for providing relative movement between the first and second portions of the first end assembly.

7. The system of claim 4, wherein the first portion of the second end assembly is anchored to a mandrel for restricting movement of the first portion of the second end assembly, the second portion of the second end assembly operatively connected to the first portion of the first end assembly for enabling movement of the second portion of the second end assembly based on movement of the first portion of the first end assembly.

* * * * *